US006001031A

United States Patent [19]

San Juan

[11] Patent Number: 6,001,031

[45] Date of Patent: Dec. 14, 1999

[54] THROUGH CHANNEL BACK GOLF CLUB HEAD DESIGN

[76] Inventor: Jon P. San Juan, 1212 E. Gates St., Anaheim, Calif. 92804

[21] Appl. No.: 08/777,695

[22] Filed: Dec. 20, 1996

[51] Int. Cl.[6] ..... A63B 53/04

[52] U.S. Cl. ..... 473/340; 473/342; 273/DIG. 14; 273/DIG. 3; 273/DIG. 8

[58] Field of Search ..... 473/342, 324, 473/340, 329, 250, 251, 240; 273/DIG. 14, DIG. 3, DIG. 8

[56] References Cited

U.S. PATENT DOCUMENTS

| | | | |
|---|---|---|---|
| 3,847,399 | 11/1974 | Raymont | 473/350 |
| 3,873,094 | 3/1975 | Sebo | 473/340 |
| 4,573,685 | 3/1986 | Young | 273/DIG. 14 |
| 4,749,196 | 6/1988 | Podgor | 273/DIG. 14 |
| 5,078,398 | 1/1992 | Reed | 273/DIG. 14 |
| 5,460,377 | 10/1995 | Schmidt | 273/DIG. 14 |
| 5,620,382 | 4/1997 | Cho | 473/342 |

*Primary Examiner*—Sebastiano Passaniti
*Attorney, Agent, or Firm*—John P. Halvonik

[57] ABSTRACT

A golf club head having a sweet spot area of lighter weight than the perimeter surround it. The sweet spot area on the front of the club is filled with a lightweight material that extends toward the rear of the club and is both lighter in weight than the surrounding club head material and having a light transmitting quality. The material may serve as a light passageway for sunlight to travel from the rear of the club to the front face of the club and so illuminate the sweet spot on the front face of the club.

9 Claims, 4 Drawing Sheets

FIG. 1
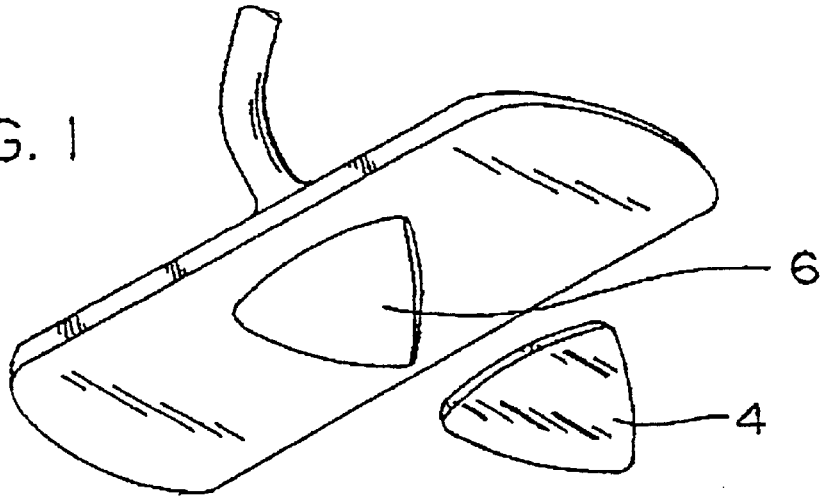
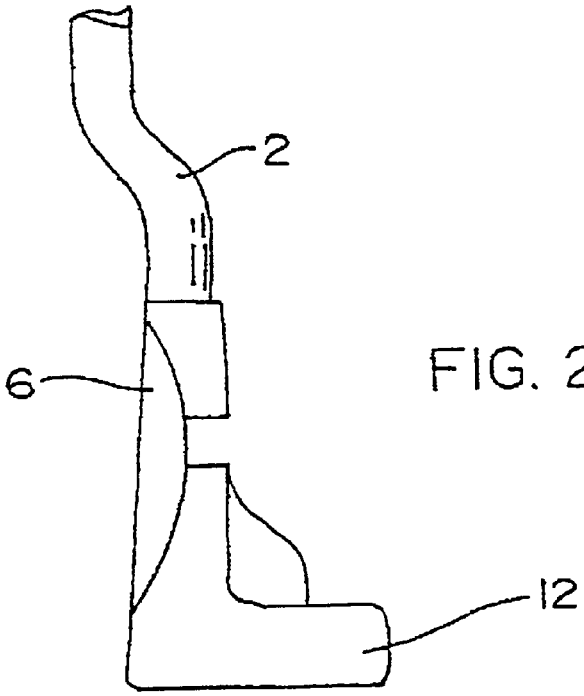
FIG. 2
FIG. 3
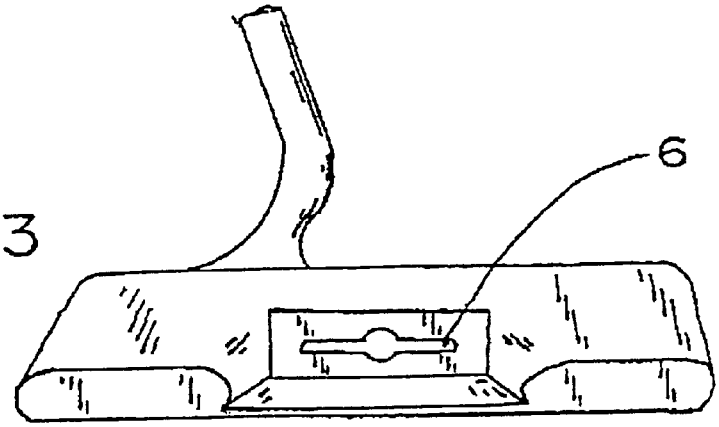

FIG. 9
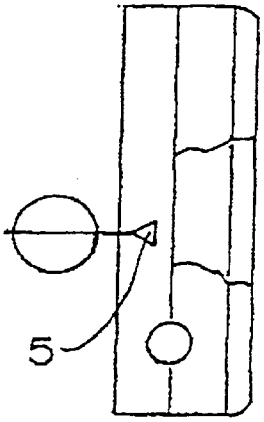
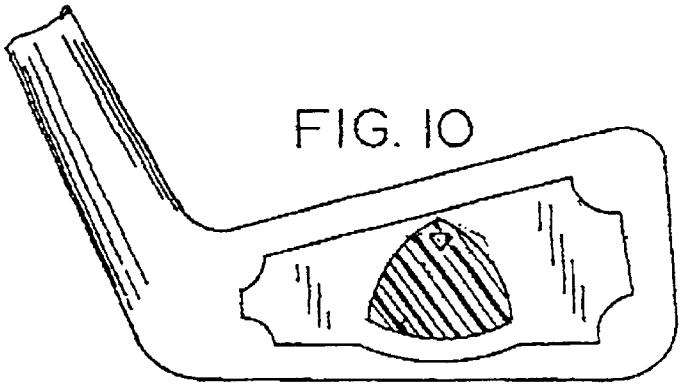
FIG. 10
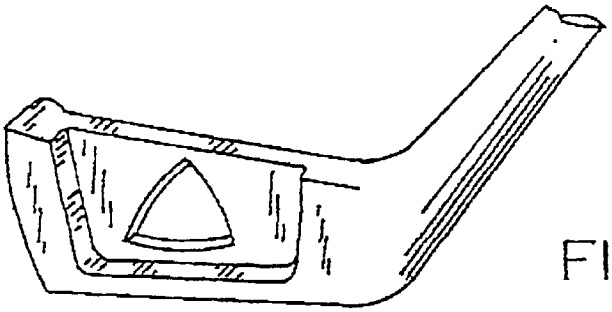
FIG. 12
FIG. 11
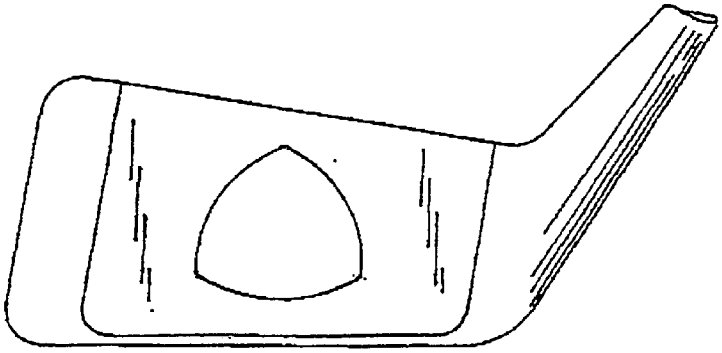

FIG. 13A
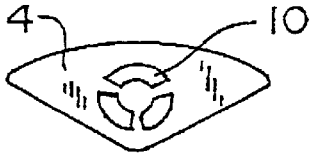
FIG. 13B
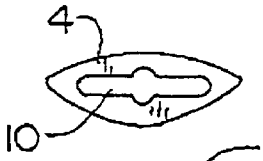
FIG. 13C
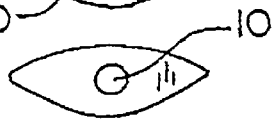
FIG. 13D
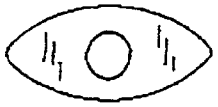
FIG. 13E
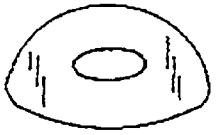
FIG. 13F
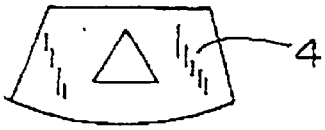
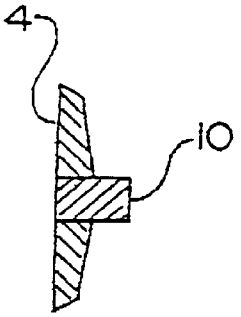
FIG. 14
FIG. 15B
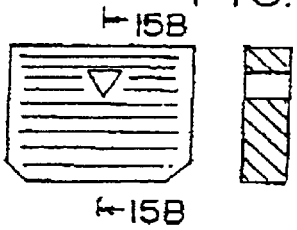
FIG. 15A
FIG. 16B
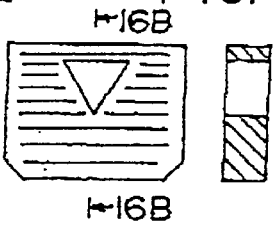
FIG. 16A
FIG. 17B
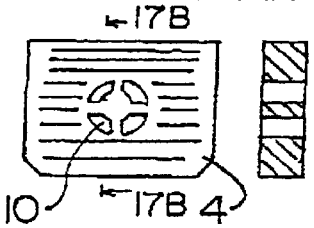
FIG. 17A

THROUGH CHANNEL BACK GOLF CLUB HEAD DESIGN

FIELD AND BACKGROUND OF THE INVENTION

The invention relates to the field of golf clubs, and in particular, to a golf club head design having a sweet spot area that is reduced in weight and mass with a perimeter area of heavier mass and also having a light transmitting passage in connection with the front face and rear of the club in order to provide a lighting element at the front of the face in order to illuminate the sweet spot. The "perimeter" area is that area of the club head that surrounds the area of the sweet spot.

The sweet spot is that area on the front of the club usually found near the center of the face of the head and is believed to be the best place upon which to strike the ball. For purposes of discussion, the sweet spot may be said to extend through the depth of the golf club head from the front face to the rear of the head. Such a line going through the center of the head as shown is also likely to be the deepest part of the head as measured from the face to the rear. The present design is believed to have utility in connection with various golf club heads including: putters, drivers, and irons.

It is believed that by reducing the weight and mass of the golf club in the area of the sweet spot the club head will be forgiving of miss hits and will provide a corrective action when miss hits do occur. Such action is believed to be due to the action of the heavier area around the sweet spot that will resist twisting due to heavier material located, above, below, and left and right of the sweet spot area.

In addition, it is thought that the improved sweet spot design provides a way to control vibration in the club head at the moment of impact. The light weight filler material of the insert is believed to absorb the shock at impact. Vibration created at impact is then routed through the channel and dissipated out the rear side of the club head. By controlling vibration in this fashion, the amount of time the ball is in contact with the front face of the club head will be increased and this will result in enhanced controllability and feel of the club while hitting the ball.

SUMMARY OF THE INVENTION

A golf club head having a sweet spot filler area on the front of the club and extending toward the rear of the club that is both lighter in weight than the surrounding club head material and also having a light transmitting quality. Such a reduced area may be filled with a lightweight material that is transmissive to light. The sweet spot area should extend through the depth of the club head and so provide a passage from the front of the head to the rear. Such passage may serve as a light passageway for light to travel from the rear of the club to the front face of the club and so illuminate the sweet spot on the front face of the club.

It is among the objective of the invention to provide a golf club head having a forgiving sweet spot and an illuminated strike face.

Another objective is to provide golf clubs such as drivers, irons and putters, with heads having a light passage that extends through such heads and so effectively illuminate the front striking face of such golf clubs.

Another objective is to provide golf clubs with heads that are lighter in that area of the golf club head known as the sweet spot and so provide a golf club head with a more forgiving sweet spot area.

Another objective is to provide golf clubs with a head having an access port for light in the rear of the club and so be able to illuminate the front face of the club with natural light from the rear of the club.

Other objectives will be known to those skilled in the art once the invention is shown and described.

DESCRIPTION OF DRAWINGS

FIG. 1 blow apart view of putter with insert;

FIG. 2 side view of putter with insert;

FIG. 3 rear view of putter and insert;

FIG. 9 top view of putter;

FIG. 10 rear view of iron with insert;

FIG. 11 front view of iron without insert;

FIG. 12 front view of iron with insert removed;

FIGS. 13*a–f*, various configurations of putter inserts and illuminating elements;

FIG. 14 front view of typical putter insert and illuminating element;

FIGS. 15*a*–17*b*, views of face of irons with optional illuminating inserts.

DESCRIPTION OF THE PREFERRED EMBODIMENT

The invention may find utility on putters, irons and woods and any other type of clubs that the golfer may carry. A preferred construction of the channel and insert system is shown for a putter in FIGS. 1–3; 6–8. That system for irons is similar and shown in FIGS. 4–5; 9–12 and 15. Woods will use the same system without any significant changes in the overall arrangement of the removed portion (or through channel) 6 and insert 4.

The system includes a through channel 6; so named because it extends from the front face of the club 12 back to the rear surface on the other side of the club. The shaft or hosel of the club is shown as 2. The channel is filled with an insert 4 made of a light weight material. The front surface of the insert and channel should be at least as large as the sweet spot area on the front face of the club in order that the insert 4 will be at least as large as the sweet spot. As the sweet spot area is at or near the center of the face the channel should be as well. The channel should extend through the cross section of the head as shown in FIG. 2 (similar construction for woods and irons).

Figure 6:
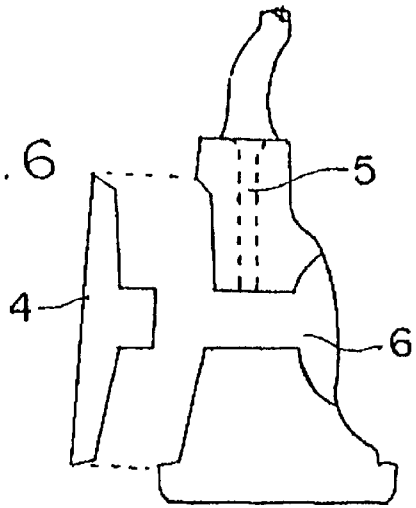
FIG. 6 side view of putter with optional channel.

There should be a large opening at the front face of the club that is of larger area than the insert itself. This front opening provides a space for the main insert 4 that may be secured into this front opening. This insert should be at the normal point of impact when the ball is struck. There is an optional upper passage and corresponding insert 5 that connects the top of the club (putter, iron or wood) with the main insert 4. This passage will also have an insert that is made of light transmissive material so that light that reaches the top of the club may illuminate the insert in the front face of the club and also provide a visual reference point in relation to the desired impact region. It is preferred that the insert be of a length sufficient to extend from the front, striking surface of the putter to the rear surface as shown in FIGS. 2 and 6.

The two openings 5 and 6 may connect with one another and so create a passage or void that has a volume that encompasses the area of the front face of the club and also extends through the depth of the club head. Both inserts 4 and 5 may be of light transmissive materials such as thermoplastics, thermoset materials, ceramics, rubber, and composite materials. Such filler material should be chosen from those materials having light transmitting qualities and so provide a light passageway that can illuminate the front face of the club. Light that enters the top of the club through the optional passage can travel to the front face of the club. Its illuminating properties will also allow the top of passage 5 to serve as a visual alignment reference point (see FIG. 9)

Figure 4:
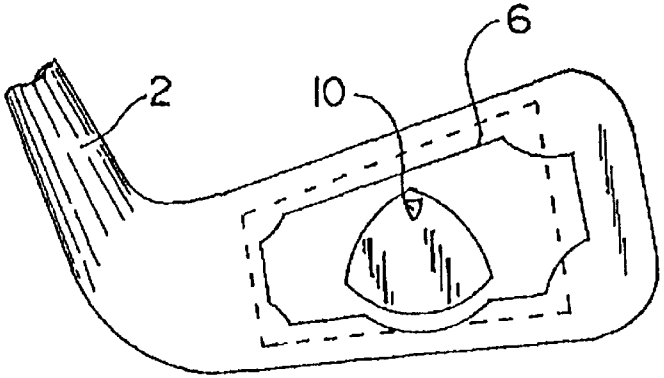
FIG. 4 rear view of iron with insert.
Figure 5:
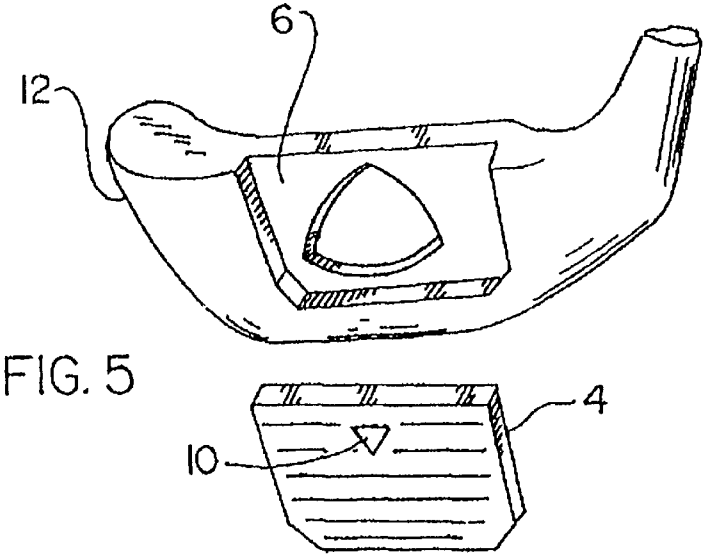
FIG. 5 front view of iron with insert.
Figure 7:
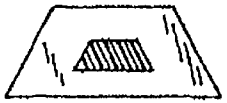
FIG. 7 view of insert.
Figure 8:
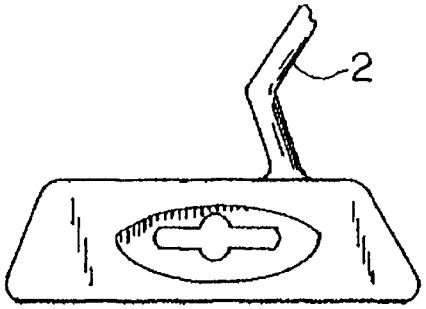
FIG. 8 front view of putter with insert.

Optionally, the main insert 4 may be made of two part construction as shown in FIGS. 4–5; 13–15. In this case the large insert 4 is made of relatively hard material that surrounds a smaller and relatively lighter light transmitting insert 10. The harder insert may be made of such materials such as those listed above and also including: metals, metal alloys, ceramics, compressed fiber and composites. The small opening insert may be of triangular shape or other shapes shown in FIG. 13F. The light from channel 5 can illuminate that smaller insert and thus highlight the sweet spot of the club (iron, putter, or wood). As an option, the small insert can be dispensed with and the shape of the larger insert 4 can, by itself, provide the lighted visual cue to indicate the sweet spot.

Both the position and the shape of the insert 4 may be used to illuminate the sweet spot of the club. The position of the insert 4 should be as close to the sweet spot as can be determined. The size and shape of the insert should be chosen to point out the sweet spot to the golfer. For example, using a triangular-shaped, smaller insert 10 (like that shown in FIG. 13) will provide an arrow shape that points toward the sweet spot. Other shapes are possible without varying from the spirit of the invention. FIGS. 13A and 15C show illustrations of a ring shaped smaller insert. It is believed that the illuminated spot will cause the golfer to focus more on the sweet spot and the impact area of the club and so improve his swing.

The channel 6 may be cast or otherwise cut in the club head in order to create the passageway that connects the front face with the rear of the club. The insert should be light transmissive and may be made of different materials such as: epoxy, resin, and hard plastics. Polymeric materials, such as acrylics, polycarbonates, polyalkylenes, polyvinyls, polyamides, polyurethanes, polyesters, and nylon being preferred.

The face of putters, irons and woods may be illuminated in the manner shown herein. The shape as well as the size of the light transmitting material used in the insert may vary in accordance with the needs of the club. For example, a triangular shape, e.g. that shown in FIGS. 1, 4, and 5 may be used in order to provide a pin point target on the sweet spot for the golfer to use in guiding his swing.

The use of a club head having a heavier area around the sweet spot than the sweet spot itself serves to enhance the sweet-spot by providing direct perimeter support around the impact area. Pin pointed weight and mass have been removed from the center of the sweet spot through the use of the passage and thus the weight and mass are distributed outwardly around the sweet spot.

The use of lighter material in the club head at the sweet spot is believed to provide a more forgiving club head. In other words, one that is likely to correct itself by resisting the tendency of the club head to twist during the impact of off-centered hits. This is because the material around the sweet spot is heavier than the materials within the sweet spot themselves. The material in the sweet spot should be chosen so as to be considerably lighter in weight than its surrounding material. The impact area of the sweet spot will be encompassed by the rest of the head that is of heavier mass than the material in the sweet spot. It is believed that this design will enhance the area of the sweet spot and provide a club that is more forgiving of miss hits.

I claim:

1. An improved golf club having a shaft and a head in connection with said head, comprising a golf club head in connection with a shaft, said head having a front face, a top surface, a bottom surface and a rear surface, a sweet spot insert substantially surrounding said club head and in connection with said rear surface and extending substantially along the entire depth of the club head and located said front face and at about the center of said front face, said sweet spot insert comprising a material that is light transmissive and is of lighter weight than the material of that area of said club head that surrounds said sweet spot.

2. The apparatus of claim 1 wherein said light transmissive material chosen from the group comprising; thermoset, thermoplastic and polymeric materials, so as to provide a path for light to illuminate said front face.

3. The apparatus of claim 2 wherein said insert is of a triangular shape.

4. The apparatus of claim 2 wherein said light transmission material is chosen from group comprising: plastics, rubber, ceramics, metals, and metal alloys, resins, epoxy, urethanes, compressed fiber, and composites.

5. The apparatus of claim 4 wherein said insert is of a triangular shape.

6. The apparatus of claim 1 wherein said insert is of a triangular shape.

7. The apparatus of claim 1 wherein said club has an open ended channel extending through said club head from said front face to said rear surface; and said sweet spot insert in connection with said front face and said rear surface so as to completely fill said through channel.

8. The apparatus of claim 7 wherein said golf club head is vertically divided by a plane defined by a line extending from said shaft and through said club head, so that said front face and said rear surface are on opposite sides of said plane, a portion of said rear surface in connection with said top surface so as to form an upper portion above said sweet spot insert, and a portion of said rear surface in connection with said lower surface so as to form a bottom portion below said sweet spot insert, wherein said lower portion extends from said plane to a greater extent than said upper portion.

9. The apparatus of claim 8 having a second channel extending from said top surface of said club head and in connection with said through channel.

* * * * *